US005868840A

United States Patent [19]

Klein, II et al.

[11] Patent Number: 5,868,840

[45] Date of Patent: Feb. 9, 1999

[54] PAINT GUN INCORPORATING A LASER DEVICE

[75] Inventors: Richard J. Klein, II; Douglas L. Sevey, both of Waterloo, Iowa

[73] Assignee: The University of Northern Iowa Foundation, Cedar Falls, Iowa

[21] Appl. No.: 781,895

[22] Filed: Dec. 30, 1996

[51] Int. Cl.[6] ..... B05C 11/00; B67D 5/03

[52] U.S. Cl. ..... 118/300; 118/713; 239/71; 239/DIG. 14; 356/375; 356/381

[58] Field of Search ..... 427/510; 118/300, 118/712, 713; 239/DIG. 14, 71; 356/375, 387, 381

[56] References Cited

U.S. PATENT DOCUMENTS

| | | |
|---|---|---|
| Re. 34,749 | 10/1994 | Leong et al. . |
| 1,349,336 | 8/1920 | Haddock . |
| 2,316,751 | 4/1943 | Adler, Jr. . |
| 2,376,836 | 5/1945 | Tunnicliffe . |
| 2,532,104 | 11/1950 | King . |
| 2,629,516 | 2/1953 | Badham . |
| 3,117,480 | 1/1964 | Peddinghaus . |
| 3,731,743 | 5/1973 | Marshall . |
| 4,291,839 | 9/1981 | Brett . |
| 4,427,880 | 1/1984 | Kanade et al. . |
| 4,444,495 | 4/1984 | Bramwell et al. . |
| 4,556,815 | 12/1985 | Ohhashi et al. . |
| 4,614,300 | 9/1986 | Flacoff . |
| 4,702,931 | 10/1987 | Falcoff . |
| 4,836,671 | 6/1989 | Bautista . |
| 4,922,852 | 5/1990 | Price . |
| 4,972,798 | 11/1990 | Ando et al. . |
| 4,982,897 | 1/1991 | Matusita et al. . |
| 5,152,841 | 10/1992 | Medler et al. . |
| 5,160,086 | 11/1992 | Kuykendal et al. . |
| 5,327,218 | 7/1994 | Igaki . |
| 5,351,126 | 9/1994 | Takada et al. . |
| 5,355,083 | 10/1994 | George et al. . |
| 5,369,486 | 11/1994 | Matsumoto et al. . |
| 5,517,768 | 5/1996 | Aviv ..... 427/510 |
| 5,564,830 | 10/1996 | Böbel et al. . |
| 5,598,972 | 2/1997 | Klein, II et al. . |

FOREIGN PATENT DOCUMENTS

| | | |
|---|---|---|
| 0007207 | 1/1980 | European Pat. Off. . |
| 454561 | 10/1991 | European Pat. Off. . |
| 3148293 | 2/1984 | Germany . |
| 5-154422 | 6/1993 | Japan . |
| 06163499 | 6/1994 | Japan . |
| 178330 | 12/1992 | U.S.S.R. . |

OTHER PUBLICATIONS

Laser Displacement Sensors, LB–1000 Series, Keyence Corporation of America, Cat. No. LB3.

Analog Sensor Controller, Model: RV3–55B/RV3–55R, Keyence Corporation of America, Cat. No. RV3, 1992.

Product Guide, Keyence Corporation of America, Cat. No. PG–93.

*Primary Examiner*—James Engel
*Assistant Examiner*—Calvin Padgett
*Attorney, Agent, or Firm*—Andrus, Sceales, Starke & Sawall

[57] ABSTRACT

A spray gun for applying a liquid spray coating, such as paint, to a surface incorporates a light source and detection system for analyzing the position of the spray gun relative to a worksurface in order to optimize application of the coating to the surface. The light source is preferably in the form of a laser which emits a beam of light toward the worksurface. The laser is interconnected with the housing of the spray gun in a location over the spray gun handle so as not to effect the center of gravity of the spray gun. Optical sensors are mounted to the spray gun housing for receiving light reflected from the work-surface, and the sensors are interconnected with a processor for providing the operator with a real time visual indication as to compliance with predetermined paint application criteria. In addition, information can be stored to memory and downloaded for subsequent analysis.

13 Claims, 1 Drawing Sheet

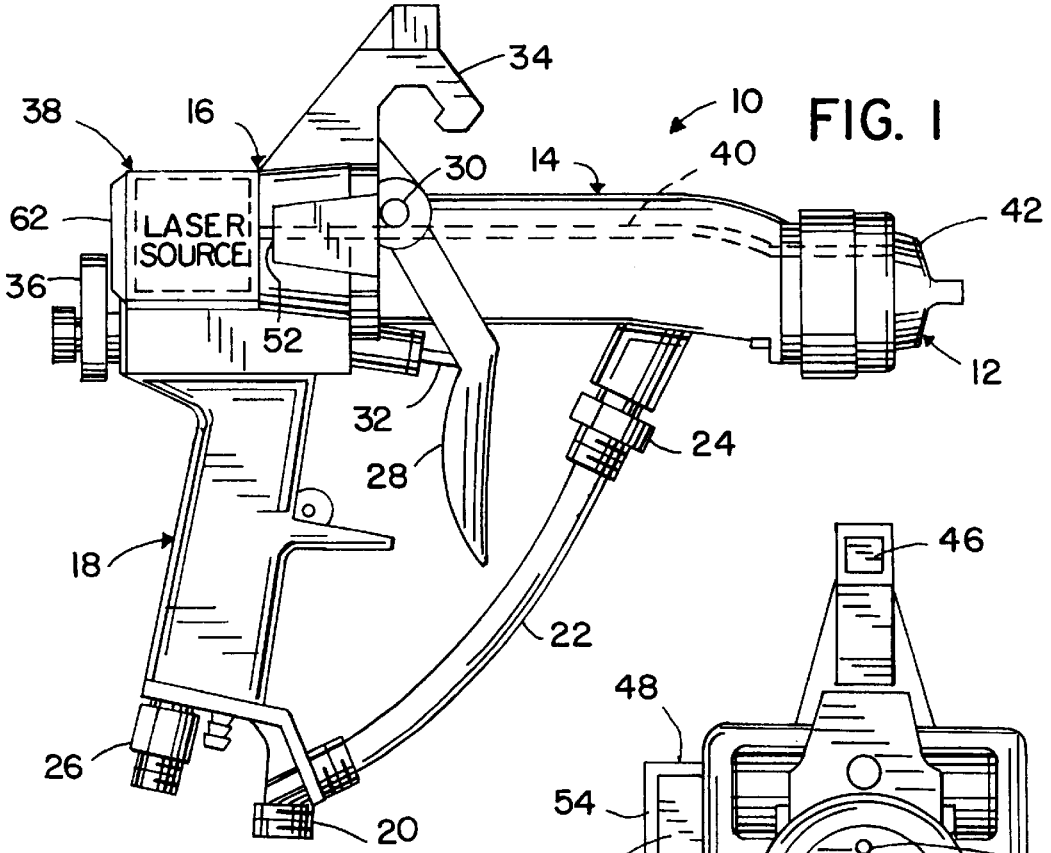
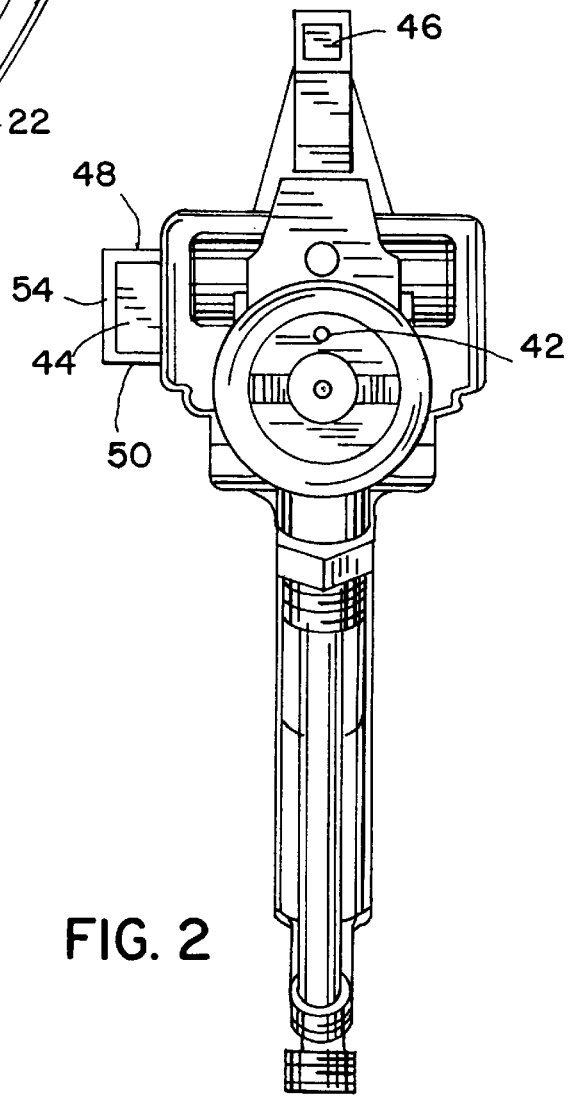
FIG. 2
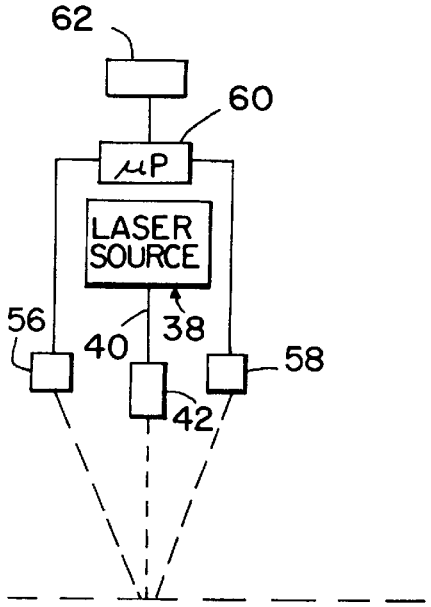
FIG. 3

PAINT GUN INCORPORATING A LASER DEVICE

BACKGROUND AND SUMMARY OF THE INVENTION

This invention relates to spray painting systems, and more particularly to a spray painting optimization system that can reduce paint waste and improve operator efficiency in application of paint or other coating to a surface.

Spray paint guns spray paint from a nozzle with compressed air onto a surface being painted. In order to optimize the quality of the finish of the painted surface, it is important to maintain the spray gun at an optimal position relative to the surface. Most importantly, the distance of the nozzle from the surface and the angle of the spray gun relative to the surface must be carefully controlled in order to apply the paint to the surface in a manner which minimizes paint waste and maximizes efficiency in applying the paint to the surface while maintaining the appropriate thickness of paint applied.

Co-pending application Ser. No. 08/504,370 filed Jul. 19, 1995 (now U.S. Pat. No. 5,598,972 issued Feb. 4, 1997, assigned to the same assignee as the present application, discloses an optical spray paint optimization system in which a laser device is mounted alongside a spray gun. The laser device emits a split beam which converges toward the surface. The operator positions the spray gun such that the light beams converge into a single point of light on the surface, for providing a visual indication as to whether the nozzle is a predetermined distance from the surface. The point of convergence of the light beams can be adjusted to provide the optimal distance of the nozzle from the surface to accommodate for varying operator conditions and paint characteristics.

Co-pending application Ser. No. 08/658,935 filed May 30, 1996, also owned by the same assignee as the present application, discloses an optical feedback system utilizing a laser device mounted alongside a spray gun in which light from the laser is reflected from the surface and received by one or more optical sensors or input devices interconnected with a processor. The optical input devices provide input signals to the processor which are used to provide a real-time indication to the operator as to the position of the nozzle, so as to enable the operator to place the nozzle and apply the paint in a manner which minimizes waste and maximizes efficiency in applying the paint to the surface. The optical input devices can also supply raw data to a processor or computer after the painting operation, to analyze overall efficiency and compliance with standards or other operating parameters.

The disclosures of the above-referenced applications are hereby incorporated by reference.

As set forth above, a light beam, such as a beam emitted by a laser, can be effectively used in combination with a paint spray system in order to optimize application of the paint to the surface. Past efforts have involved mounting a laser device to the spray gun in somewhat of a retrofit manner, typically at a location adjacent the nozzle portion of the spray gun. This mounting of the laser device moves the overall center of gravity of the assembly when compared to that of a spray gun without a laser device, and to which an operator is accustomed. The operator must compensate by adjusting his grip on the gun and the motions used to move the gun when applying the paint to the surface.

It is an object of the present invention to incorporate a light-emitting device, such as a laser device, into a spray gun without any significant effect on the overall center of gravity of the spray gun. It is a further object of the invention to incorporate a laser and optical sensor apparatus into the housing of spray gun without significantly altering the overall configuration of the spray gun. Still another object of the invention is to incorporate a laser and optical sensor apparatus into a spray gun such that the light emitting and light receiving components of the apparatus are located in optimal positions.

In accordance with the invention, a hand-held spray gun for applying a coating to a surface includes a housing having a handle and defining an interior. A nozzle is mounted to the housing for discharging the liquid coating from the spray gun. A light generating device is disposed within the interior of the housing and includes a light-emitting source for communicating a light beam from the light generating device exteriorly of the housing. A light receiving optical sensor device is mounted to the housing for receiving light reflected from the surface for use in generating information pertaining to application of the coating to the surface. The housing defines a forward end and a rearward end. The handle is located toward the rearward end of the housing, and the nozzle is located toward the forward end of the housing. The light generating device is preferably located toward the rearward end of the housing, and the light source is preferably located toward the forward end of the housing. In a particularly preferred form, the light source is located adjacent the nozzle. The housing defines a box-like portion adjacent its rearward end, and the light generating device is disposed within the box-like portion. The handle is interconnected with the box-like portion and extends downwardly therefrom. The light receiving is located rearwardly of the housing forward end, and is preferably disposed rearwardly of the light source. In a preferred form, the light receiving device is mounted to the box-like portion of the housing within which the light generating device is disposed. The light receiving device preferably is in the form of a pair of light receiving windows facing toward the forward end of the housing and spaced from each other for receiving light at two distinct locations upon reflection of the light beam from the surface.

The invention also contemplates an improvement in a spray gun including housing, substantially as set forth in the foregoing paragraph.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a side elevation view of a paint spray gun incorporating a light emitting device and a light receiving device in accordance with the present invention;

FIG. 2 is a front elevation view of the paint spray gun of FIG. 1; and

FIG. 3 is a schematic representation of the components of the paint spray gun of FIG. 1.

DETAILED DESCRIPTION OF THE INVENTION

FIG. 1 illustrates a spray gun 10 constructed according to the invention. Spray gun 10 uses compressed air to spray a coating, such as paint, from a nozzle 12 onto a surface or object being coated (not shown). Generally, spray gun 10 includes a housing defining a spray head section 14 extending forwardly from a box-like body section 16. A handle 18, in the form of a hand grip, extends downwardly from body section 16. Spray head section 14, body section 16 and handle 18 define an interior to the housing of spray gun 10.

In a manner as is known, a paint supply fitting 20 is mounted to the lower end of handle 18 via a bracket, for supplying paint from a paint supply (not shown) to spray head section 14 through a tube 22 and a fitting 24. A compressed air inlet fitting 26 is also interconnected with the lower end of handle 18 via a bracket, for supplying compressed air to body section 16. A trigger 28 is pivotably mounted to body section 16 via a pin 30, and is operable to control the position of a valve plunger 32 for selectively discharging pressurized air from body section 16 into spray head section 14 for mixing with paint from supply tube 22, with the mixture then being discharged through nozzle 12 onto a surface to be coated.

Body section 16 includes an upstanding hook 34, which enables spray gun 10 to be hung for storage when not in use. Control levers, such as shown at 36, are mounted to the rearward end of body section 16 for turning spray gun 10 on and off and for controlling the flow of pressurized air through body section 16 when trigger 28 is depressed.

In accordance with the present invention, a light generating source 38 is incorporated into housing body section 16. Light generating source 38 may be any satisfactory device for generating an intense beam of light, and in a preferred embodiment may be a class II diode laser. A fiber optic cable 40 extends forwardly from light generating source 38 through the interiors of housing body section 16 and spray head section 14. Cable 40 terminates at the forward end of spray head section 14, and an opening 42 (FIG. 2) is formed in nozzle 12 so as to enable the beam of light emitted by fiber optic cable 40 to pass through nozzle 12 and forwardly toward the surface being painted.

Housing body section 16 includes a pair of light receiving windows shown at 44, 46. Window 44 is surrounded by top and bottom walls 48, 50, respectively, and end wall 52 (FIG. 1) and a side wall 54 (FIG. 2). Walls 48–54 extend from, and are preferably formed integrally with, the side wall of housing body section 16 and enclose a space rearwardly of window 44. Similarly, window 46 is surrounded by a series of walls extending from the upper end of hook 34, and which are preferably formed integrally therewith. The walls surrounding window 46 enclose a space rearwardly of window 46. In a manner as set forth in co-pending application Ser. No. 08/658,935 filed May 30, 1996, windows 44, 46 receive all or a part of the beam of light emitted by the light source of fiber optic cable 40 when reflected off the surface being painted, as shown in FIG. 3. Optical sensors, shown at 56, 58 are located in the enclosures behind windows 44, 46, respectively, to detect such reflected light, and are interconnected with a processor 60 to provide an output as to the distance and angle of spray gun 10 and its nozzle 12 relative to the surface. A feedback/control 62 is mounted to the rearwardly facing wall of housing body section 16, and includes a visual readout providing real time information to the operator as to compliance with predetermined operating or application parameters. For example, processor 60 can be programmed to provide a simple visual indication through feedback/control 62 as to whether or not the operator is in compliance with operating parameters known to provide optimal application of paint to a surface, with such parameters as gun angle and distance being preprogrammed into processor 60 and external conditions such as temperature, humidity and paint data being input to processor 60 through feedback/control 62. In addition, processor 60 and feedback/control 62 can be used to acquire raw data pertaining to application of paint to the surface, and may include a communications port for downloading such data into a computer or the like for subsequent processing.

The location of windows 44, 46 rearwardly of the light source provided by nozzle opening 42 enables the light beam reflected from the surface to spread more than would be possible if windows 44, 46 were in the same plane as the light source. This increases the ability of windows 44, 46 to receive reflected light from the surface for input to optical sensors 56, 58. In addition, the provision of windows 44, 46 at distinct spaced locations ensures that one of the optical sensors will be functional to provide information to processor 60 in the event the other optical sensor fails or if one of the windows is obstructed.

It is understood that light generating source 38 could be any source of light and is not limited to a laser-type source. In addition, the light source could emanate from any location facing the worksurface, and is not limited to opening 42 in nozzle 12. For example, a separate protrusion could be incorporated into spray head section 14 for enclosing the end of fiber optic cable 40 and pointing it toward the worksurface.

It can thus be appreciated that the invention incorporates a light source and optical sensor system into a spray gun without affecting the general overall configuration of the spray gun and without affecting the center of gravity of the spray gun. The spray gun can thus be used by an operator without modifying existing techniques, and enables the operator to increase his or her efficiency and reduce waste by providing a real time visual output to the operator.

Various alternatives and embodiments are contemplated as being within the scope of the following claims particularly pointing out and distinctly claiming the subject matter regarded as the invention.

We claim:

1. A hand-held spray gun for applying a liquid coating to a surface, comprising:

a spray gun housing defining an interior;

handle structure interconnected with the housing and adapted for manual engagement by an operator;

a nozzle interconnected with the housing for discharging the liquid coating from the housing to the surface to be coated;

a light generating device disposed within the interior of the housing, wherein the light generating device includes a light-emitting arrangement for communicating a light beam exteriorly of the housing and toward the surface to be coated;

a light receiving device mounted to the housing and including a light receiving arrangement having an exposure exteriorly of the housing for receiving light from the light-emitting arrangement reflected from the surface to be coated; and an operator interface interconnected with the light receiving device for conveying information to the operator pertaining to application of the coating to the surface in response to the light receiving device.

2. The spray gun of claim 1, wherein the housing defines a forward end and a rearward end, wherein the handle is located toward the rearward end and the nozzle is located toward the forward end.

3. The spray gun of claim 2, wherein the light generating device is located toward the housing rearward end and the light-emitting arrangement is located toward the housing forward end.

4. The spray gun of claim 3, wherein the light-emitting arrangement is located adjacent the nozzle.

5. The spray gun of claim 3, wherein the housing defines a box-like portion adjacent its rearward end, wherein the light generating device is disposed within the box-like portion and wherein the handle is interconnected with and extends downwardly from the box-like portion.

6. The spray gun of claim 2, wherein the light receiving device is located rearwardly of the housing forward end.

7. The spray gun of claim 6, wherein the housing defines a box-like portion adjacent its rearward end, wherein the light receiving device is mounted to the box-like portion.

8. The spray gun of claim 7, wherein the light generating device is disposed within the box-like portion and wherein the handle is interconnected with and extends downwardly from the box-like portion.

9. The spray gun of claim 6, wherein the light receiving device comprises a pair of light receivers facing toward the forward end of the housing and spaced from each other for receiving light at two distinct locations upon reflection of the light beam from the surface.

10. In a spray gun including a housing defining an interior and a nozzle mounted to the housing for applying a liquid coating to a surface, the improvement comprising:

a light generating device disposed within the housing and including a light-emitting source for communicating a light beam from the light generating device exteriorly of the housing toward the surface;

a light receiving device comprising an optical sensor mounted to the housing and having an exposure exteriorly of the housing for receiving light upon reflection of the light beam from the surface;

a processor mounted to the spray gun and interconnected with the optical sensor; and a visual readout interconnected with the processor for providing a visual indication to the operator as to application of the coating to the surface.

11. The improvement of claim 10, wherein the visual readout is mounted to a rearwardly facing surface of the housing.

12. A hand-held spray gun for applying a liquid coating to a surface, comprising:

a housing defining an exterior and having a forward end and a rearward end;

a handle interconnected with the housing toward its rearward end;

a nozzle interconnected with the housing toward its forward end for discharging the liquid coating therefrom;

a light generating device disposed within the interior of the housing toward the rearward end of the housing;

a light source interconnected with the housing toward the forward end of the housing and located adjacent the nozzle, wherein the light source is interconnected with the light generating device and functions to emit a light beam exteriorly of the housing toward the surface; and one or more light receiving devices mounted to the housing and located rearwardly of the housing forward end, wherein each light receiving device includes a light receiving arrangement having an exposure exteriorly of the housing for receiving light upon reflection of the light beam from the surface to be coated; and an operator interface interconnected with the light receiving device for conveying information to the operator pertaining to application of the coating to the surface in response to the light receiving device.

13. A hand-held spray gun for applying a liquid coating to a surface, comprising:

a spray gun housing defining an interior;

handle structure interconnected with the housing and adapted for manual engagement by an operator;

a nozzle interconnected with the housing for discharging the liquid coating from the housing to the surface to be coated;

a light generating device disposed within the interior of the housing, wherein the light generating device includes a light-emitting arrangement for communicating a light beam exteriorly of the housing and toward the surface to be coated;

a light receiving device disposed within the interior of the housing and including a light receiving arrangement having an exposure exteriorly of the housing for receiving light from the light-emitting arrangement reflected from the surface to be coated; and a processor disposed within the interior of the housing and interconnected with the light receiving device for generating information pertaining to application of the coating to the surface in response to the light receiving device.

* * * * *